US012467275B2

(12) United States Patent
Zhu

(10) Patent No.: US 12,467,275 B2
(45) Date of Patent: Nov. 11, 2025

(54) COLLAPSIBLE SHELTER WITH CENTRAL DRIVE ACTUATION FOR SYNCHRONIZED EXPANSION/RETRACTION IN UNISON

(71) Applicant: MAXTON ENGINEERING LTD., Central (HK)

(72) Inventor: Shou Qiang Zhu, Central (HK)

(73) Assignee: MAXTON ENGINEERING LTD., Central (HK)

( * ) Notice: Subject to any disclaimer, the term of this patent is extended or adjusted under 35 U.S.C. 154(b) by 106 days.

(21) Appl. No.: 17/968,814

(22) Filed: Oct. 19, 2022

(65) Prior Publication Data

US 2023/0175284 A1 Jun. 8, 2023

Related U.S. Application Data

(60) Provisional application No. 63/257,568, filed on Oct. 19, 2021.

(51) Int. Cl.
*E04H 15/50* (2006.01)

(52) U.S. Cl.
CPC ..... *E04H 15/50* (2013.01)

(58) Field of Classification Search
CPC ..... E04H 15/50
See application file for complete search history.

(56) References Cited

U.S. PATENT DOCUMENTS

| | | | | |
|---|---|---|---|---|
| 4,607,656 | A | 8/1986 | Carter | |
| 4,779,635 | A | 10/1988 | Lynch | |
| 4,947,884 | A | 8/1990 | Lynch | |
| 6,058,951 | A | 5/2000 | Wilson | |
| 6,076,312 | A | 6/2000 | Carter | |
| 6,129,102 | A | 10/2000 | Carter | |
| 6,230,729 | B1 | 5/2001 | Carter | |
| 6,772,780 | B2 | 8/2004 | Price | |
| 7,178,542 | B2 | 2/2007 | Carter | |
| 7,644,720 | B2 | 1/2010 | Chen | |
| 8,919,364 | B1 | 12/2014 | Russell | |
| 9,995,056 | B2 * | 6/2018 | Yang | E04H 15/50 |
| 9,995,058 | B2 * | 6/2018 | Jin | G08C 17/02 |
| 10,145,141 | B2 | 12/2018 | Lovley, II | |
| 2002/0074032 | A1 * | 6/2002 | Park | E04H 15/50 135/131 |

(Continued)

FOREIGN PATENT DOCUMENTS

| | | | | |
|---|---|---|---|---|
| CN | 2133630 Y | | 5/1993 | |
| CN | 112227824 A | * | 1/2021 | E04H 15/50 |

*Primary Examiner* — David R Dunn
*Assistant Examiner* — Danielle Jackson
(74) *Attorney, Agent, or Firm* — LIU & LIU

(57) ABSTRACT

A collapsible shelter having a folding frame assembly, in which a plurality of leg assemblies are disposed at the corners. A central drive mechanism is disposed at a center of the perimeter, and a framework of a plurality of actuation members operatively coupled to the central drive mechanism and to the leg assemblies. The actuation members are structured and configured to move the leg assemblies towards and away from the central drive mechanism; and a canopy supported on the folding frame assembly. The central drive mechanism is configured to operate to simultaneously actuate the plurality of actuation members to move the leg assemblies in synchronization, thereby to expand and collapse the folding frame assembly in unison.

19 Claims, 19 Drawing Sheets

(56) References Cited

U.S. PATENT DOCUMENTS

| | | | |
|---|---|---|---|
| 2005/0072451 | A1 | 4/2005 | Vivian |
| 2006/0289048 | A1 | 12/2006 | Choi |
| 2008/0023053 | A1 | 1/2008 | Chan |
| 2008/0092936 | A1 | 4/2008 | Carabillo |
| 2008/0190469 | A1 | 8/2008 | Amsel |
| 2021/0102399 | A1 | 4/2021 | Tomchak |

* cited by examiner

COLLAPSIBLE SHELTER WITH CENTRAL DRIVE ACTUATION FOR SYNCHRONIZED EXPANSION/RETRACTION IN UNISON

PRIORITY CLAIM

This application claims the priorities of U.S. Provisional Patent Application No. 63/257,568 filed on Oct. 19, 2021. This application is fully incorporated by reference as if fully set forth herein. All publications noted below are fully incorporated by reference as if fully set forth herein.

FIELD OF THE INVENTION

The present invention is directed to collapsible shelters with a folding frame.

BACKGROUND OF THE INVENTION

Collapsible shelters, of the type sometimes referred to as pop-up tents or canopies, are useful in providing temporary shelter (e.g., shade). They can be easily transported in the collapsed configuration and set up/erect in the expanded configuration to provide shelter.

Heretofore, collapsible shelters include a framework of pivoting X-shaped linkages, four telescopic legs (for a rectangular shelter), and a canopy made of a flexible material (e.g. fabric) covering the framework, as disclosed, for example, in U.S. Pat. Nos. 4,607,656, 6,076,312 and 6,129,102.

Heretofore, as exemplified by U.S. Pat. No. 6,076,312, at least two persons are required to collapse or expand the folding frame of the collapsible shelter. To expand the folding frame to erect the rectangular shelter, the two persons each hold on two adjacent legs and pull to expand the folding frame. To collapse the folding frame, the two persons each hold on two adjacent legs and push to collapse the folding frame. In addition to expanding/collapsing the folding frame, the two persons need to extend/retract the telescopic legs, so as to raise the shelter to the desired height/shorten the legs for stowing/transporting the collapsed shelter. It is rather inconvenient for at least two persons to be available to handle expanding/collapsing the folding frame, including extending/retracting the telescopic legs. Furthermore, the frame structure of the collapsible shelter involves a rather complex configuration, leading to a less compact overall structure when the collapsible shelter is in the collapsed configuration, in addition to higher material and manufacture costs.

U.S. Pat. No. 6,129,102 discloses in its Abstract, a collapsible shelter that includes a truss framework that provides an elevated, raised canopy that can be gabled or have a high peak in a raised, extended configuration. The canopy is supported by at least three legs, and outer perimeter and central truss pairs of link members pivotally connected in scissors configurations. The link members of the perimeter truss pairs are pivotally connected together in a scissors configuration so as to be extendable from a first collapsed position extending horizontally between adjacent legs to a second extended position extending above the legs, to elevate the canopy in a gabled or high peaked configuration. In a preferred embodiment, tensioning cables may also be secured between the legs and a central support connected to the central truss pairs, to provide additional strength and stability to the framework of the shelter in a raised, extended configuration. This collapsible shelter shares similar deficiencies as U.S. Pat. No. 6,076,312, namely, this collapsible shelter also requires the inconvenience of at least two persons to handle manually expanding/collapsing the truss framework, and further to manually extending/retracting the telescopic legs. Furthermore, the structure of the truss framework of the collapsible shelter is rather complex configuration, leading to a less compact overall structure when the collapsible shelter is in the collapsed configuration, in addition to higher material and manufacture costs.

There is a need for a simple and reliable folding frame for a collapsible shelter that is easy to operate, involving minimum user manual handling.

SUMMARY OF THE INVENTION

The present invention provides a simple and reliable folding frame for a collapsible shelter that is easy to operate, involving minimum user manual handling, which overcomes the drawback of the prior art collapsible shelters. The inventive collapsible shelter can be easily erected/expanded for use and collapsed with minimum user intervention. This is achieved by configuring the folding frame assembly for the collapsible shelter to deploy a central drive actuation mechanism for coordinated and/or synchronized expansion and retraction of the components of the folding frame in unison. As will be further appreciated from the detailed description and the drawings hereinbelow, the inventive collapsible shelter includes a folding frame assembly that can be actuated automatically by a central drive actuator to expand/collapse with components moving in synchronization in a coordinated fashion in unison, with no or minimum user manual involvement or intervention beyond a user's effort (e.g., controlling the central drive actuator, or the drive motor using control switches, a remote controller, or an app installed in an electronic device). Unlike the prior art collapsible shelters, the inventive collapsible shelter does not require two persons to operate to manually expand and/or collapse the folding frame assembly. The inventive collapsible shelter can be setup/erected with the components of the folding frame assembly moving in synchronization in unison in a coordinated fashion. The collapsible shelter in its collapsed configuration is compact given its less complex folding frame assembly, as compared to the prior art collapsible shelters.

In one aspect, the collapsible shelter comprises a folding frame assembly having a perimeter having at least three corners, which comprises a plurality of leg assemblies (which could be part of the folding frame assembly or coupled to the folding frame assembly), each disposed at one of the at least three corners of the perimeter; a central drive actuation mechanism, disposed at a center of the perimeter; a framework of a plurality of actuation members operatively coupled to the central drive mechanism and to the leg assemblies, wherein the actuation members are structured and configured to move the leg assemblies towards and away from the central drive mechanism; and a canopy supported on the folding frame assembly, wherein the central drive mechanism is configured to operate to simultaneously actuate the plurality of actuation members to move the leg assemblies inwards towards or outwards away from the central drive actuating mechanism in synchronization, thereby to expand and collapse the folding frame assembly in unison.

In one embodiment, the actuation members are each a pivoted actuation mechanism operatively coupled to the central drive mechanism and to a leg assembly, wherein the pivoted actuation mechanism comprises pivotally coupled members that can be pivoted to vary the overall length of the pivoted mechanism to extend/retract to move the leg assembly away/towards the central drive mechanism, and wherein the central drive mechanism is configured to operate the pivotally coupled members to simultaneously extend and retract all the pivoted mechanisms with the leg assemblies in synchronization, thereby to expand and collapse the folding frame assembly in unison.

In one embodiment, each pivotally coupled member is in the form of a radial scissor frame member comprising a linearly extendible/retractable scissor frame member defined by linked, pivoted members in a criss-cross 'X' pattern, wherein the radial scissor frame member has a first end pivotally coupled to the central drive mechanism and a second end pivotally connected to a corresponding coupling location in the perimeter, wherein the central drive mechanism is configured to operate to simultaneously extend and retract the plurality of radial scissor frame members with the leg assembles in synchronization, thereby to expand and collapse the folding frame assembly in unison.

The collapsible shelter further comprises a canopy supported on the folding frame assembly.

In one embodiment of the present invention, each radial scissor frame member is pivotally connected to an upper portion of a corresponding leg assembly at the perimeter, and wherein simultaneous extension/retraction of the radial scissor frame members operates to simultaneously move the leg assemblies radially outwardly/inwardly relative to the central drive mechanism in synchronization, thereby to expand and collapse the folding frame assembly in unison. The second end of each redial scissor frame member comprises a first pivot end portion pivotally connected to a fixed pivot joint fixedly attached to the support portion at the upper portion of each leg assembly, and a second pivot end portion pivotally connected to a slidable pivot joint that is slidably attached to the support portion at the upper portion of each leg assembly, wherein as the radial scissor frame extends, the slidable pivot joint slides along the support portion towards the fixed pivot joint, and as the radial scissor frame retracts, the slidable pivot joint slides along the support portion away from the fixed pivot joint.

In a further embodiment, the folding frame assembly further comprises a plurality of perimeter scissor frame members each comprising a linearly extendible/retractable scissor frame member defined by linked, pivoted members in a criss-cross 'X' pattern, wherein the perimeter scissor frame member extends across and has two ends pivotally connected to two adjacent leg assemblies, wherein simultaneous extension/retraction of the radial scissor frame members operate to also simultaneously extend/retract the perimeter scissor frame members in synchronization, thereby to expand/collapse the folding frame assembly in unison. Each end of each perimeter scissor frame member comprises a first pivot end portion pivotally connected to the fixed pivot joint fixedly attached to the support portion at the upper portion of each leg assembly, and a second pivot end portion pivotally connected to the slidable pivot joint that is slidably attached to the support portion at the upper portion of each leg assembly, wherein as the perimeter scissor frame extends, the slidable pivot joint slides along the support portion towards the fixed pivot joint, and as the perimeter scissor frame retracts, the slidable pivot joint slides along the support portion away from the fixed pivot joint.

In one embodiment, instead of or in addition to pivotally connecting directly to the leg assemblies, the second end of each radial scissor frame member is alternatively or additionally coupled indirectly to the leg assemblies by a plurality of perimeter scissor frame members. In one embodiment, the second end of each radial scissor frame member is pivotally connected to a mid-section of a corresponding perimeter scissor frame member, wherein simultaneous extension/retraction of the radial scissor frame members operates to simultaneously extend/retract the perimeter scissor frame members to move the leg assemblies radially outwardly/inwardly relative to the central drive mechanism in synchronization, thereby to expand/collapse the folding frame assembly in unison. The pivotal connection of the radial scissor frame member to the mid-section of the perimeter scissor frame member may be similar to the configurations described in U.S. Pat. No. 4,607,656 and/or U.S. Pat. No. 6,129,102.

In one embodiment, the leg assemblies each comprises a wheel (or a roller) at a lower end to facilitate rolling the leg assembly on a surface when the leg assembly moves outwardly/inwardly relative to the central drive mechanism.

In one embodiment, the central drive mechanism comprises a linear actuator operatively coupled to the end of each radial scissor frame member to extend/retract the radial scissor frame member. The linear actuator may be one of an electric actuator, a hydraulic actuator, a pneumatic actuator, a mechanical actuator, an electro-mechanical actuator. The linear actuator may be one of a ball screw gear, a lead screw gear, a rack and pinion gear, a cable pulley drive, etc., wherein the central drive mechanism further comprises a electric drive motor (e.g., DC motor, stepper motor) operatively coupled to the linear actuator.

The central drive mechanism may comprise a removable rechargeable power supply, providing power to the linear actuator. The central drive mechanism may be provided with a power port for receiving power from an external power supply as a backup to the rechargeable power supply. The power port may be provided on the rechargeable power supply.

In one embodiment, the central drive mechanism may comprise a wireless receiving mechanism receiving a remote control signal via at least one of Bluetooth, wife, infrared and radio frequency (RF), to operatively control the drive motor to operate the radial scissor frame members. A handheld remote control device may be provided to generate the remote control signal. Alternatively, an application module installed in an electronic device (e.g., a mobile phone) may be used to generate the remote control signal.

In an alternate embodiment, the linear actuator is configured to be operated by a manual crank drive in addition or in the alternative of an electric motor drive.

In another aspect of the present invention, to further facilitate expanding/collapsing the folding frame assembly in a coordinated fashion in synchronized unison, each leg assembly comprises an extendable/retractable structure to vary the length of the overall leg assembly to raise/lower the height of the folding frame assembly in synchronization with operations of the actuation members of the folding frame assembly. The actuation members (e.g., pivoted actuation members) are operatively coupled to the leg assemblies to synchronize extension/retraction of the leg assemblies with the extension/retraction of the actuation members thereby to expand/collapse the folding frame assembly in unison.

In one embodiment, the second end of each radial scissor frame assembly is operatively coupled to a corresponding leg assembly in a manner wherein as the central drive mechanism operates to simultaneously extend/retract the plurality of radial scissor frame members. The second end of each radial scissor frame member is simultaneously operated to extend/retract a corresponding leg assembly in synchronization with the extension/retraction of the folding frame assembly, thereby to expand and collapse the folding frame assembly in unison. Each leg assembly further comprises a telescopic structure varying the length of the overall leg assembly, comprising an elongated base section telescopic with respect to an elongated support section at the upper portion of the leg assembly. Each leg assembly further comprises a leg drive mechanism driving the base section to telescopically extend/retract with respect to the support section. The leg drive mechanism comprises one of a cable drive, a ball screw gear, a lead screw gear, a rack and pinion gear, etc.

In one embodiment, the base section of the leg assembly is telescopically received in the support section of the leg assembly, wherein the leg drive mechanism comprises a cable drive comprising a cable having a fixed length has a first end and a second end connected to a top end of the base section, wherein the slidable pivot joint is coupled to a point along the length of the cable, wherein the length of the cable is looped from the top end of the base section through an aperture at an upper portion of the support section to the slidable pivot joint, and further from the slidable pivot joint through an aperture at a lower portion of the support section to the top end of the base section. The cable comprises a first cable section having a first end corresponding to the first end of the cable connected to the top end of the base section and a second end connected to the slidable pivot joint, and a second cable section having a first end connected to the slidable pivot joint and a second end corresponding to the second end of the cable connected to the top end of the base section. The first and second cable sections may be sections of a complete cable without a break, but fixedly connected to the slidable pivot joint, or may be separate sections separately connected to the slidable pivot joint.

In one embodiment, the folding frame assembly may comprise a rectangular perimeter having four corners and 4 leg assemblies.

BRIEF DESCRIPTION OF THE DRAWINGS

FIG. 19A depicts the base section fully retracted into the support section; FIG. 19B depicts the base section fully extended out of the support section.

DETAILED DESCRIPTION OF THE INVENTION

Figure 1:
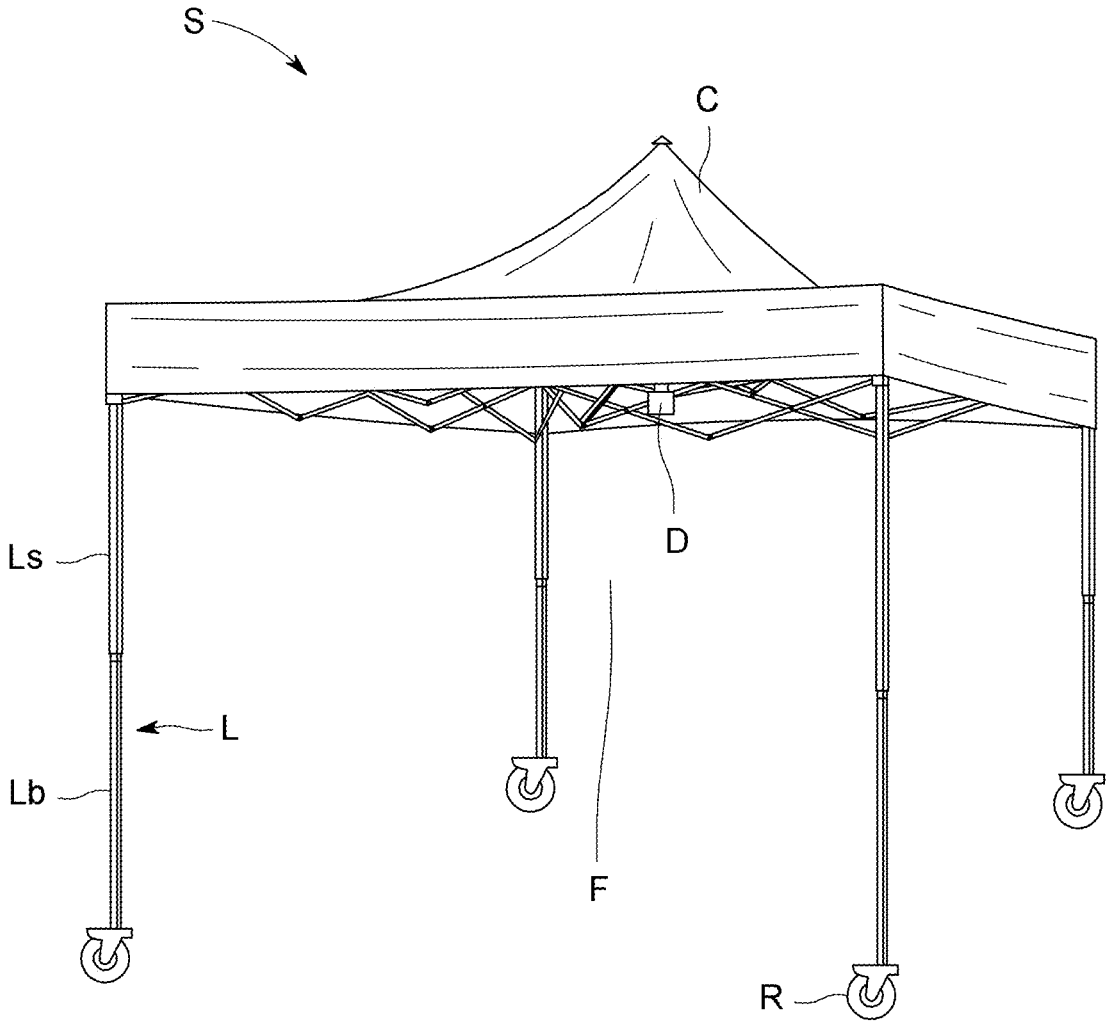
FIGS. 1-8 depict a collapsible shelter comprising a folding frame assembly in accordance with one embodiment of the present invention, which progressively transition from an expanded configuration to a collapsed configuration.
Figure 2:
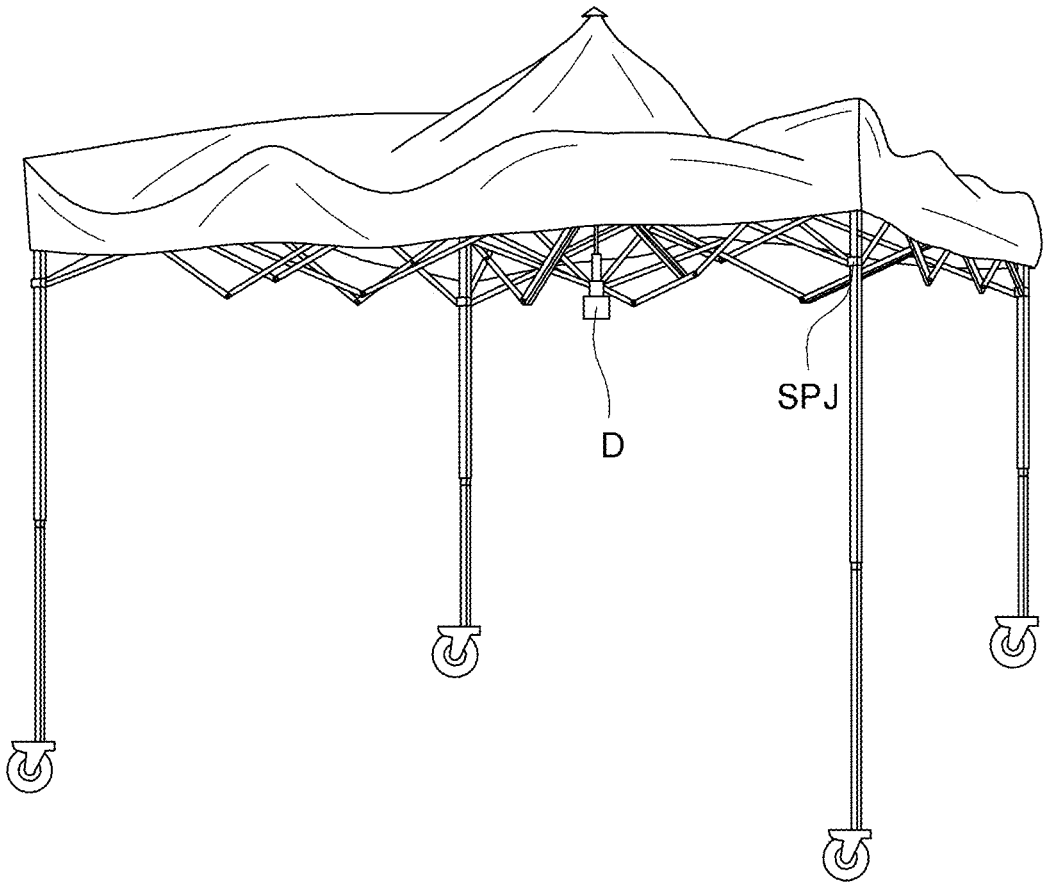
Figure 3:
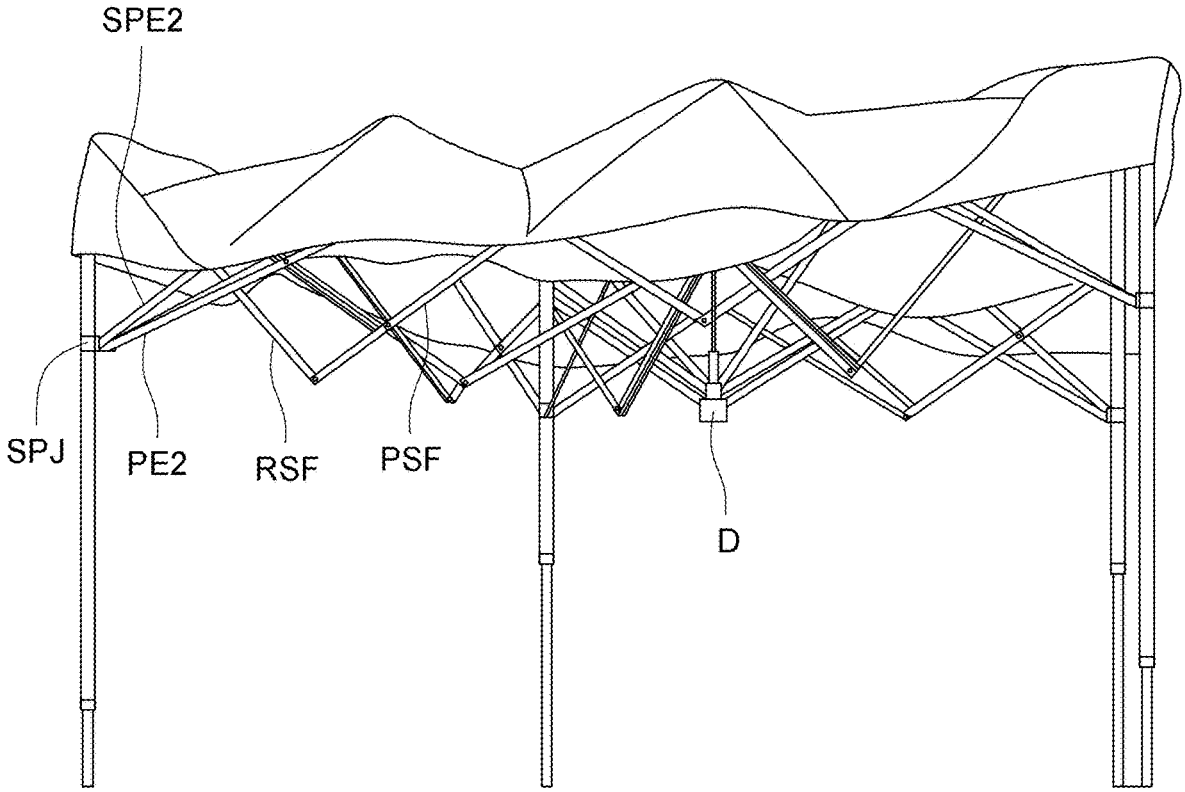
Figure 4:
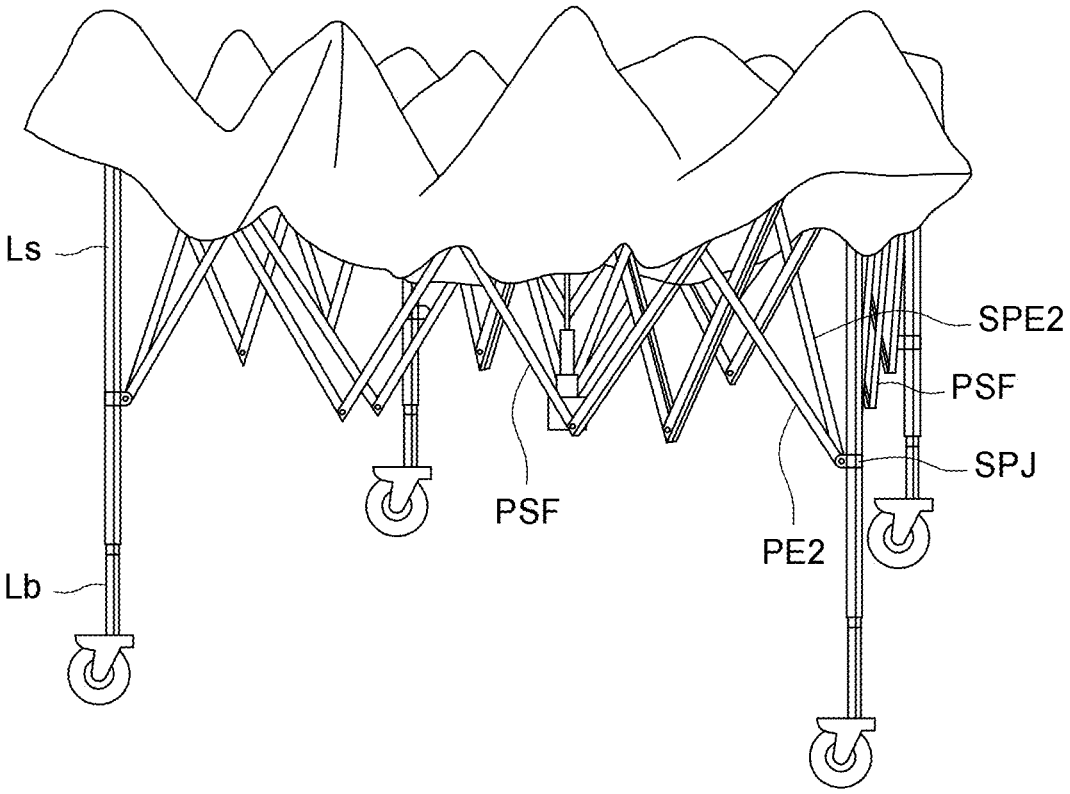
Figure 5:
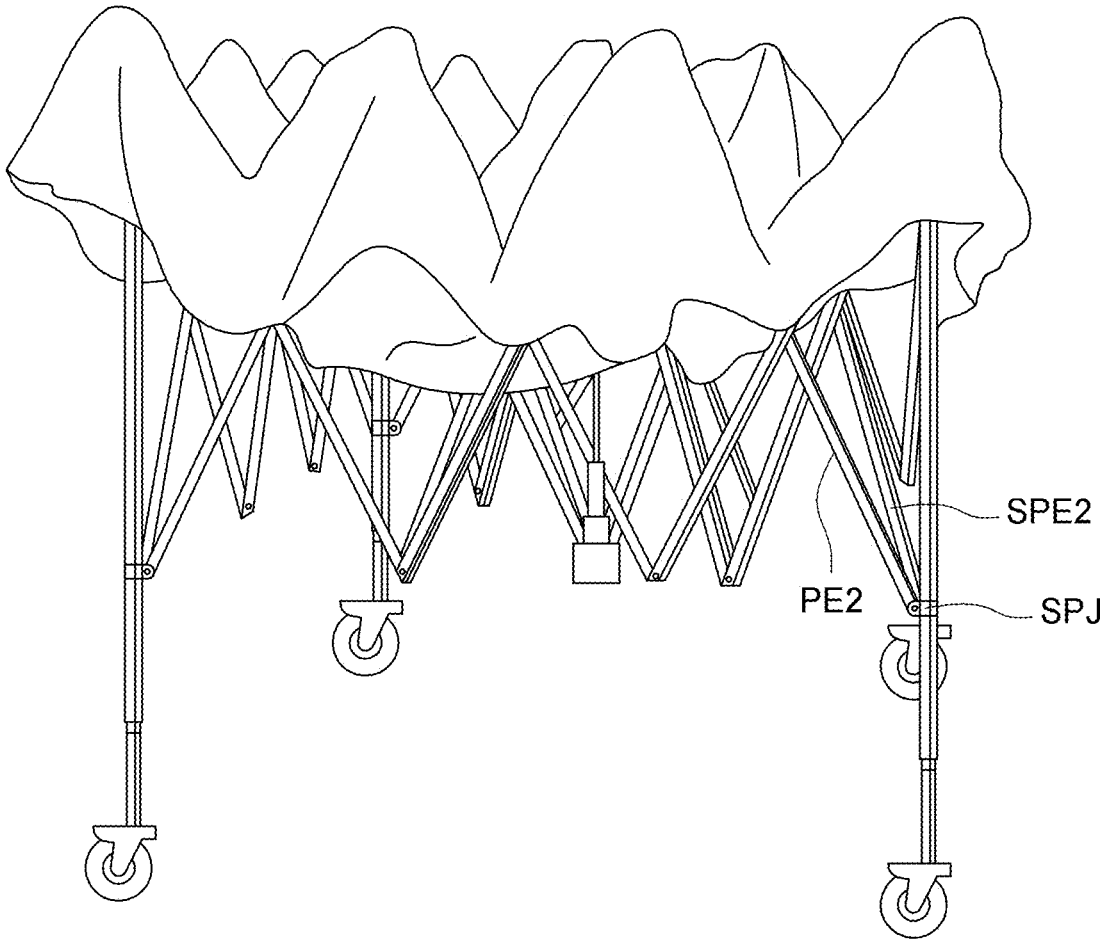
Figure 6:
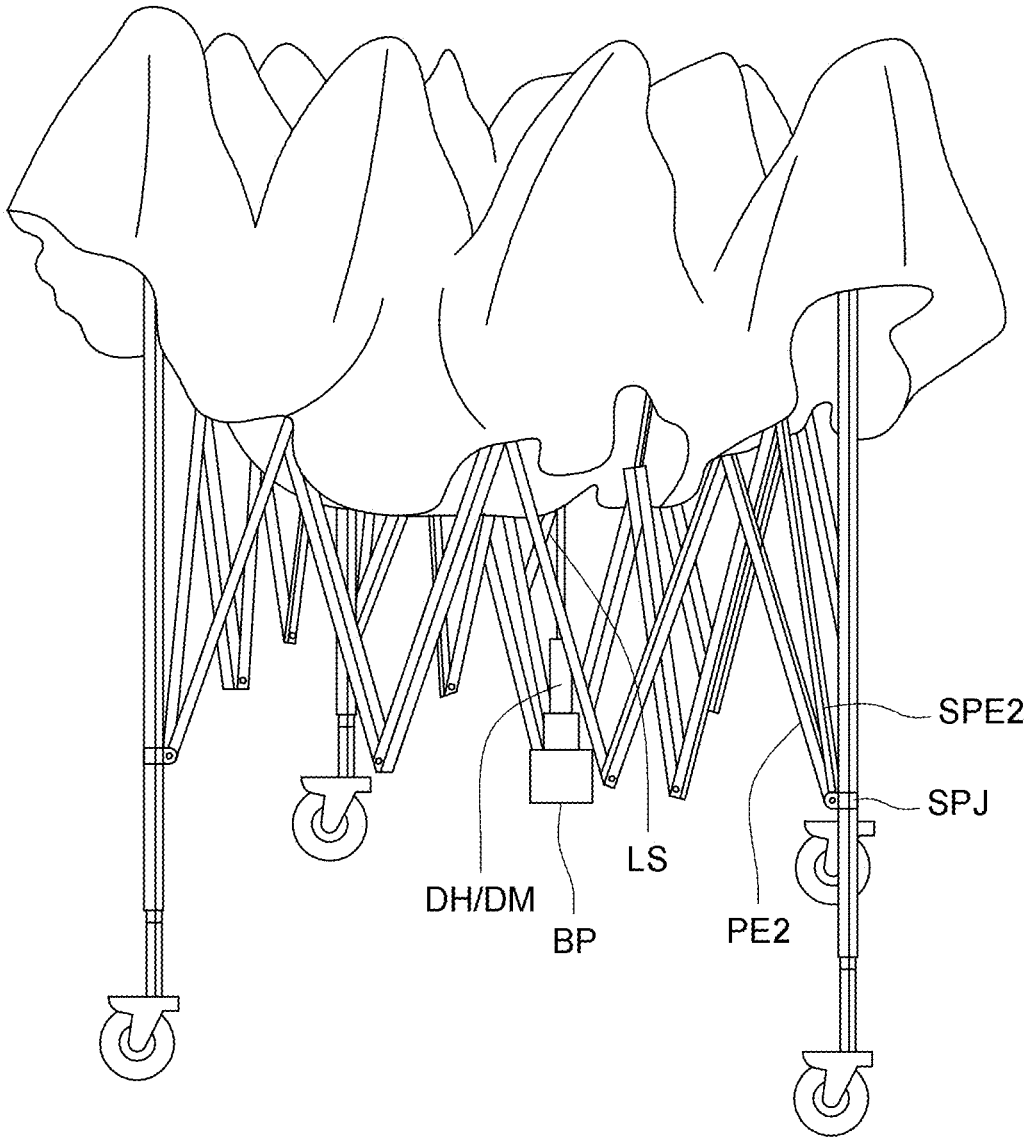
Figure 7:
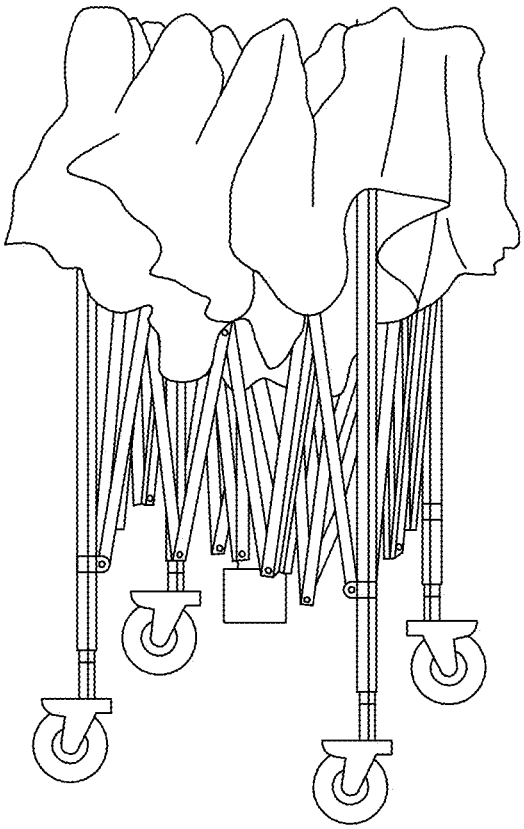
Figure 8:
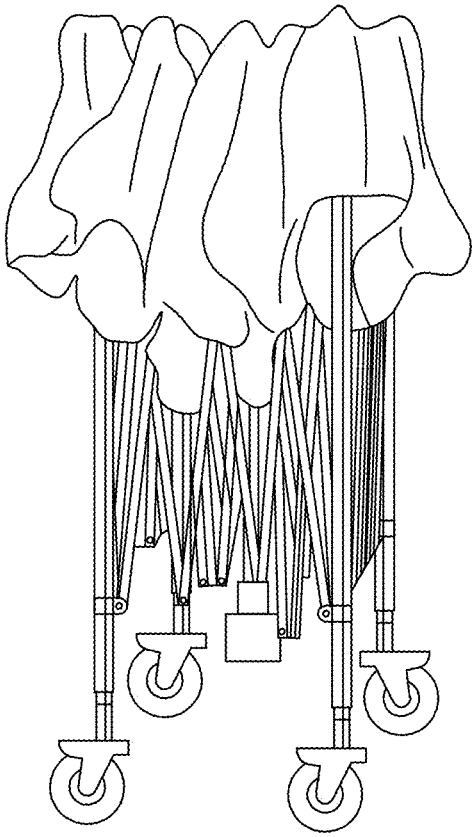
Figure 9:
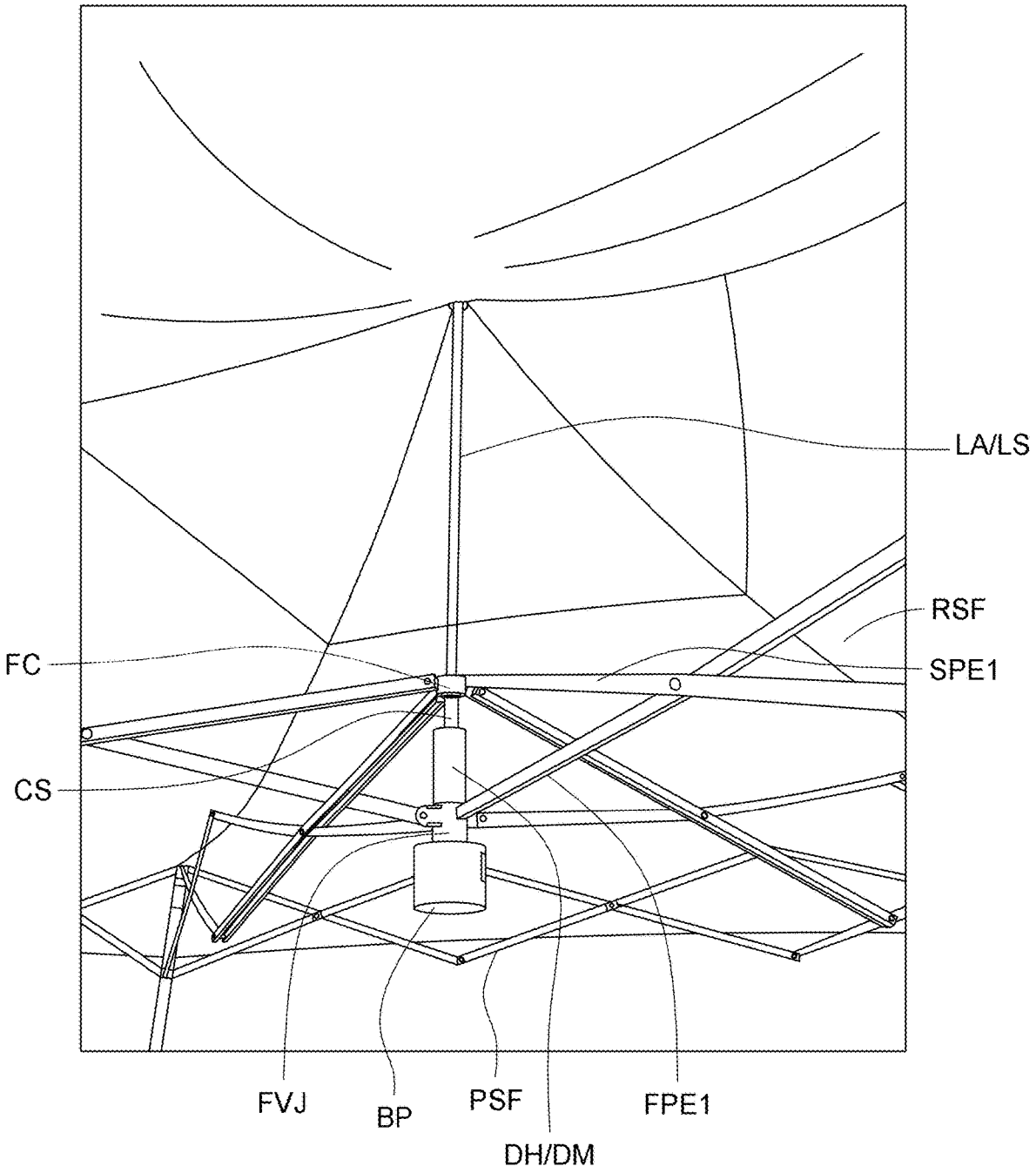
FIGS. 9-13 depict the folding frame assembly under the canopy, in a fully expanded configuration, in accordance with one embodiment of the present invention.
Figure 10:
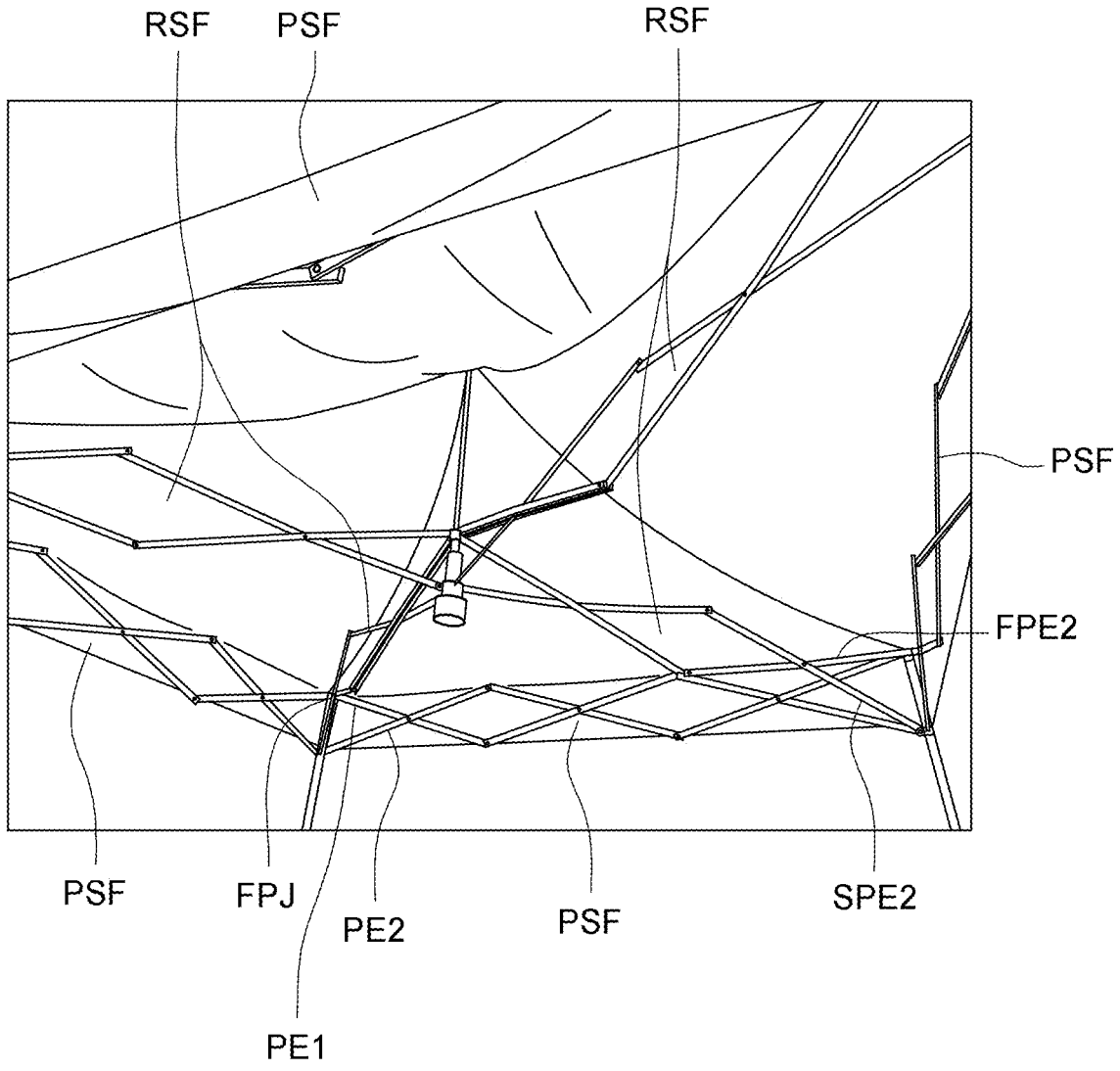
Figure 11:
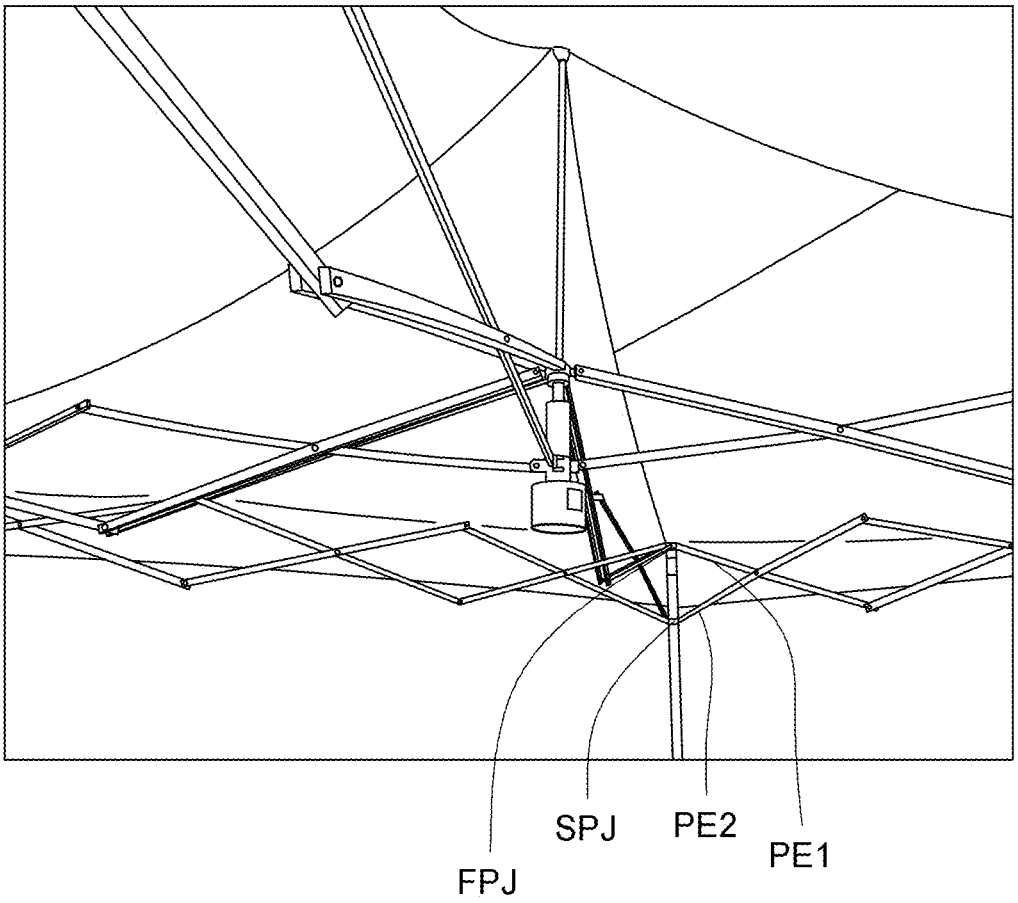

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

The present invention provides a simple and reliable folding frame assembly for a collapsible shelter that is easy to operate, involving minimum user manual handling, which overcomes the drawback of the prior art collapsible shelters. The inventive collapsible shelter can be easily erected/expanded for use and collapsed for stowing with minimum user intervention. This is achieved by configuring the folding frame assembly for the collapsible shelter to deploy a central drive mechanism for coordinated expanding and collapsing the folding frame assembly in unison.

FIGS. 1-8 depict a collapsible shelter S comprising a folding frame assembly F in accordance with one embodiment of the present invention, which progressively transitions from an expanded configuration to a collapsed configuration. FIGS. 9-13 depict the folding frame assembly F under the canopy, in a fully expanded configuration, in accordance with one embodiment of the present invention.

As illustrated, the collapsible shelter S comprises a folding frame assembly F having a perimeter having at least three corners. In the illustrated embodiment, the folding frame assembly F comprises a rectangular (e.g., square) perimeter having four corners and four leg assemblies L. In other embodiments, the folding frame assembly F may have a perimeter of other polygonal shaped, e.g., triangular, pentagon, hexagon, etc., or a generally circular or oval perimeter. The folding frame assembly F comprises a plurality of leg assemblies L, each disposed at one of the four corners in the illustrated embodiment. The collapsible shelter S further comprises a canopy C supported on the folding frame assembly F.

In one aspect of the present invention, a central drive mechanism D is disposed at a center of the perimeter. Operatively coupled to the central drive mechanism D is a framework of scissor mechanisms. In the illustrated embodiment, a plurality of radial scissor frame members RSF extends between the central drive mechanism D and the leg assemblies L at the corners of the folding frame assembly F.

Each radial scissor frame member RSF comprises a linearly extendible/retractable scissor frame member defined by linked, pivoted members in a criss-cross 'X' pattern. Each scissor frame member extends and retracts by manipulating the 'scissors' or X-patterns, in a manner that is well known in the art. The radial scissor frame member RSF has a first end pivotally coupled to the central drive mechanism D and a second end pivotally coupled to a corresponding coupling location (e.g., a corner or at a point along a section) in the perimeter.

In the illustrated embodiment, each radial scissor frame member RSF is pivotally connected to an upper portion of a corresponding leg assembly L at the corner of a perimeter. As more clearly shown in FIG. 10, the second end of each redial scissor frame RSF member comprises a first pivot end portion FPE2 pivotally connected to a pivot joint at or attached (e.g., fixedly or pivotally attached) to the upper portion of a leg assembly L (e.g., the support section of a telescopic leg assembly in one embodiment), and a second pivot end portion SPE2 pivotally connected to a slidable pivot joint SPJ that is slidably attached to the support section Ls at the upper portion of each leg assembly. As the radial scissor frame member RSF extends, the slidable pivot joint SPJ slides along the support section Ls towards the fixed pivot joint FPJ. As the radial scissor frame member RSF retracts, the slidable pivot joint SPJ slides along the support section away from the fixed pivot joint FPJ.

In one embodiment, the central drive mechanism D comprises a linear actuator LA operatively coupled to the end of each radial scissor frame member RSF to extend/retract the radial scissor frame member RSF. The linear actuator LA may be one of an electric actuator, a hydraulic actuator, a pneumatic actuator, a mechanical actuator, an electro-mechanical actuator. The linear actuator may comprise one of a ball screw gear drive, a lead screw gear drive, a rack and pinion gear drive, a cable pulley drive, etc.

Figure 15:
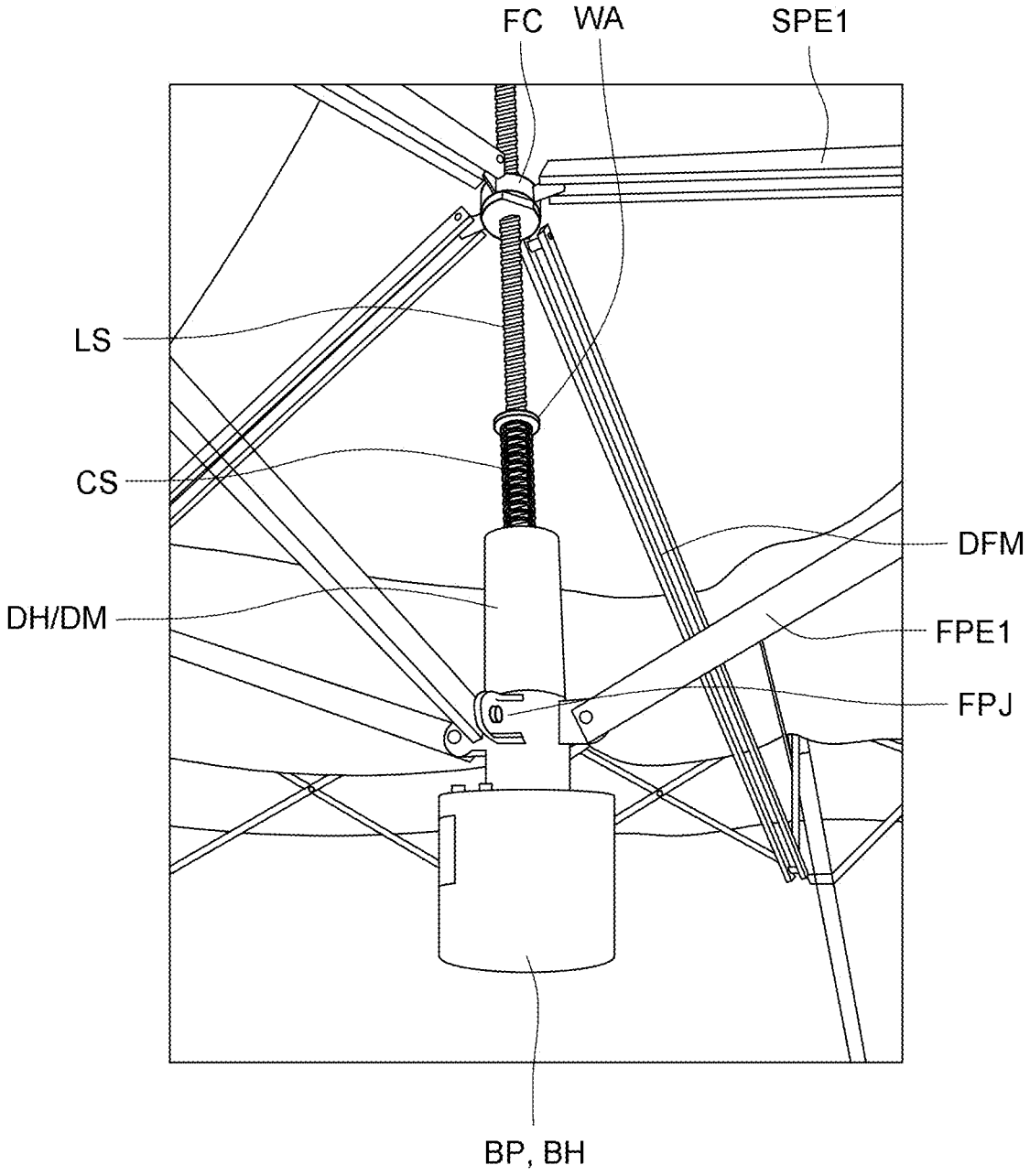
FIGS. 15-17 depict the folding frame assembly under the canopy, in a further collapsed configuration.
Figure 16:
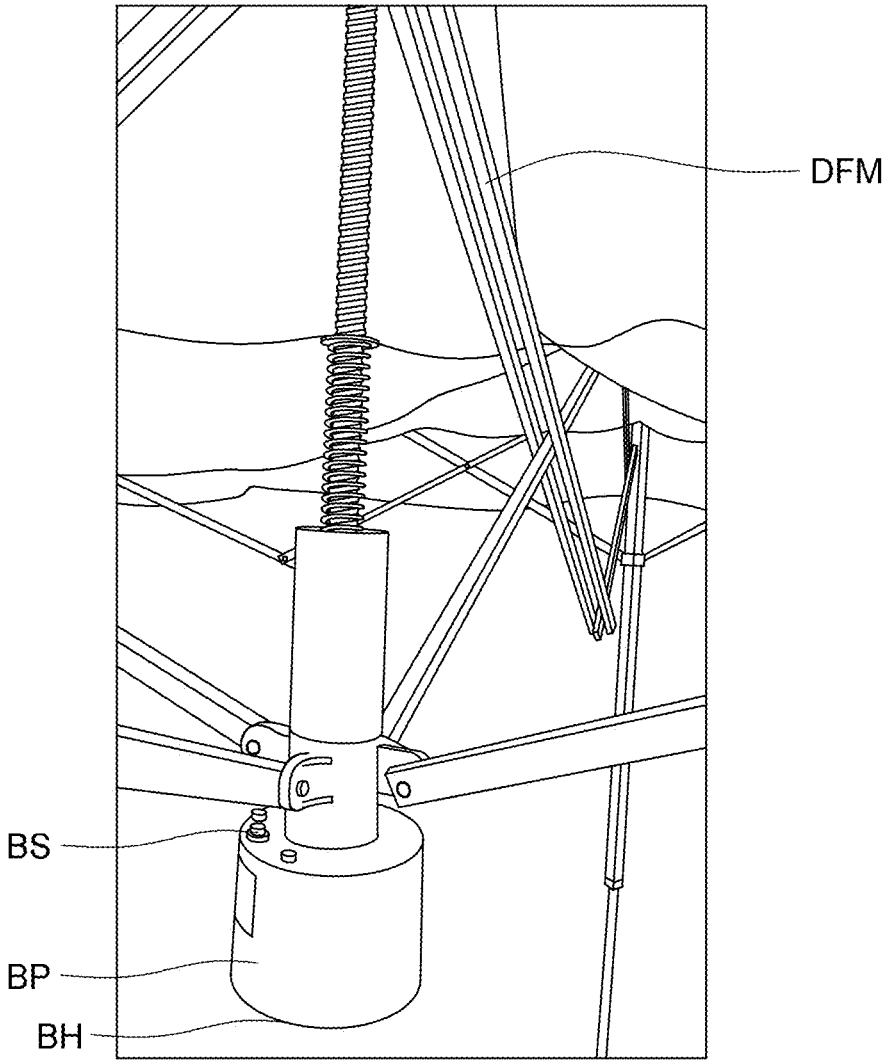

In the illustrated embodiment, the linear actuator LA comprises a lead screw gear drive. An elongated threaded lead screw LS extends vertically, with its top end supporting the center of the canopy C (e.g., the central vertex or apex of the canopy C). As more clearly shown in FIG. 9, the first end of each redial scissor frame member RSF comprises a first pivot end portion FPE1 pivotally connected to a pivot joint attached (e.g., fixedly or pivotally attached) to a lower portion of the central drive mechanism D (e.g., a fixed pivot joint at or attached to below the housing of a drive motor for the lead screw ger drive), and a second pivot end portion SPE1 pivotally connected to a pivot joint that is attached to an internally threaded follower collar FC of the lead screw gear drive, which is the load bearing component of the lead screw gear drive. As the lead screw LS rotates about its longitudinal axis, the follower collar FC rides linearly up or down the lead screw LS depending on the rotational direction of the lead screw LS. As the lead screw LS rotates to move the follower collar FC towards the fixed pivot joint FVJ, the radial scissor frame member RSF extends. As the lead screw LS rotates in the opposite direction to move the follower collar FC away from the fixed pivot joint FVJ, the radial scissor frame member RSF retracts. To improve rigidity of the radial scissor frame member RSF as it is providing pushing and pulling forces to extend and retract the leg assemblies L, one or more frame member sections of the radial scissor frame member RSF may be configured as a double frame member sections DFM. As shown in FIGS. 15 and 16, the second pivot end portion SPE1 at the first end of the radial scissor frame member RSF is configured as a double frame member sections DFM.

Figure 14:
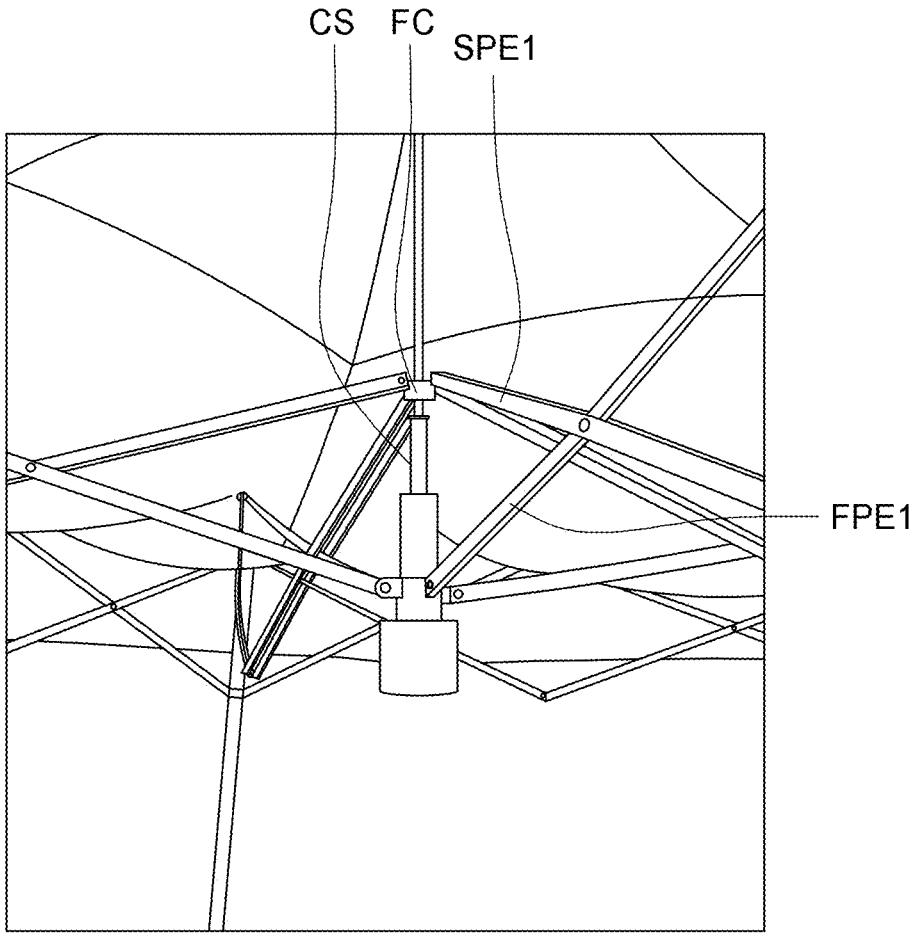
FIG. 14 depicts the folding frame assembly under the canopy, in a slight collapsed configuration.
Figure 17:
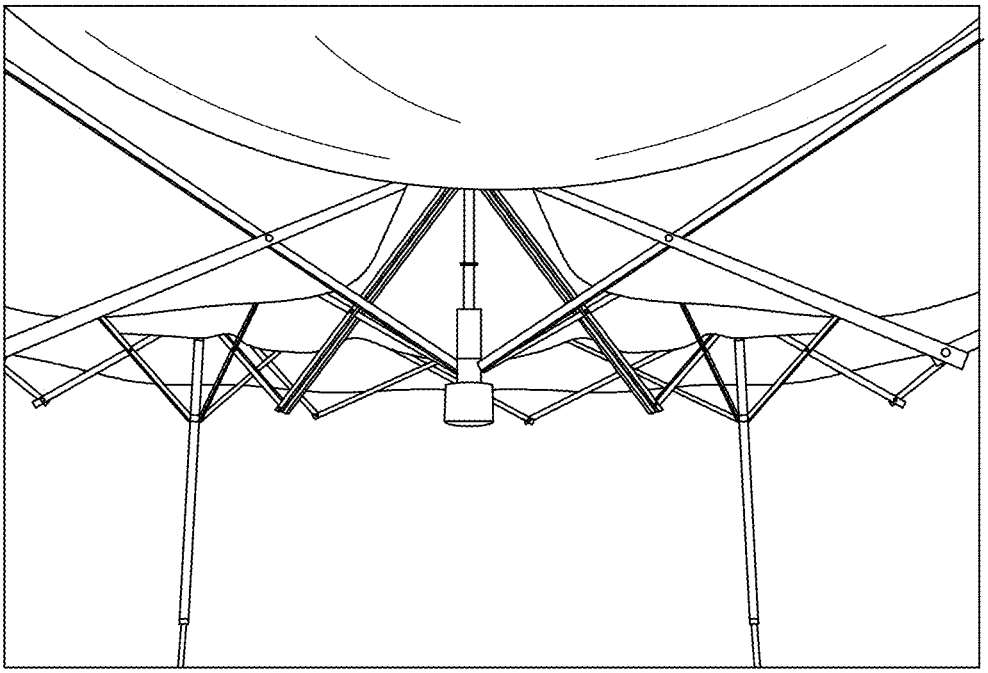

The central drive mechanism D is configured to operate to simultaneously extend and retract the plurality of radial scissor frame members RSF in unison, thereby to expand and collapse the folding frame assembly F in unison. As illustrated in FIGS. 1-8, the second pivot end portions SPE1 of all the radial scissor frame members RSF are pivotally attached to the same follower collar FC. As the lead screw LS is rotated, all the radial scissor frame members RSF are simultaneously extended/retracted, to operatively simultaneously move the leg assemblies L radially outwardly/inwardly relative to the central drive mechanism D in unison, thereby to expand and collapse the folding frame assembly F, following the sequence depicted in FIG. 1-8 to retract (including retraction of the leg assemblies L, which will be discussed later below), and the sequence in reverse to expand. FIG. 14 depicts the folding frame assembly F under the canopy C in a slight collapsed configuration, and FIGS. 15-17 depict the folding frame assembly F under the canopy C in a further collapsed configuration.

In a further embodiment, the folding frame assembly F may further comprise a plurality of perimeter scissor frame members PSF each comprising a linearly extendible/retractable scissor frame member defined by linked, pivoted members in a criss-cross 'X' pattern. Each perimeter scissor frame member PSF extends across two adjacent leg assemblies L, with its two ends pivotally coupled to the two adjacent leg assemblies L. In the illustrated embodiment, the perimeter scissor frame members PSF define the four sides of the perimeter of the folding frame assembly F. As more clearly shown in FIG. 11, each end of each perimeter scissor frame member F comprises a first pivot end portion PE1 pivotally connected to the fixed pivot joint FPJ at or fixedly attached to the support section Ls at the upper portion of each leg assembly L, and a second pivot end portion PE2 pivotally connected to the slidable pivot joint SPJ that is slidably attached to the support section at the upper portion of each leg assembly L. As the perimeter scissor frame member PSF extends, the slidable pivot joint SPJ slides along the support section Ls towards the fixed pivot joint FPJ. As the perimeter scissor frame PSF member retracts, the slidable pivot joint SPJ slides along the support section away from the fixed pivot joint FPJ.

It can be seen that with simultaneous extension/retraction of the radial scissor frame members RSF to move the leg assemblies L radially outwardly/inwardly relative to the central drive mechanism D, this would operate to also simultaneously extend/retract the perimeter scissor frame members PSF in unison, thereby to expand/collapse the folding frame assembly F in a coordinated manner in unison.

In one embodiment (not shown), instead of pivotally connecting to the leg assemblies L, the second end of each radial scissor frame member RSF is operatively connected to a point along a corresponding perimeter scissor frame member PSF, such as a mid-section of a corresponding perimeter scissor frame member PSF. Simultaneous extension/retraction of the radial scissor frame members RSF would operate to simultaneously extend/retract the perimeter scissor frame members PSF to move the leg assemblies L radially outwardly/inwardly relative to the central drive mechanism D in unison, thereby to expand/collapse the folding frame assembly F.

To facilitate movement of the leg assemblies L on a surface when the leg assemblies L move outwardly/inwardly relative to the central drive mechanism D, a wheel (or a roller) R is provided at a lower end of each leg assembly L (i.e., in the illustrated embodiment, at the lower end of the base section of the telescopic leg assembly). As the radial scissor frame members RSF are actuated to extend/retract, the leg assemblies L move on their wheels/rollers radially outwardly/inwardly with respect to the central drive mechanism D.

In one embodiment, the central drive mechanism D further comprises an electric drive motor DM (e.g., DC motor, stepper motor) operatively coupled to the linear actuator LA. In the illustrated embodiment, the lead screw LS is driven to rotate by the electric drive motor DM. Electric power may be supplied to the electric drive motor DM by a removable rechargeable power supply. In this embodiment, the removable rechargeable power supply in the form of a rechargeable battery pack BP may be attached to the base of the drive motor housing DH or the fixed pivot joint FVJ at the base of the drive motor housing DH, such as by a screw socket similar to a light bulb socket, or a plug socket. Alternatively, the battery pack BP may include a power cable that can be plug into a power port for the drive motor DM. For backup in the event of the battery pack BP is drained of power, the central drive mechanism D may be provided with a power port for receiving power from an external power supply. The power port may be provided on the rechargeable battery pack BP, or on the housing DH for the motor drive DM.

Figure 12:
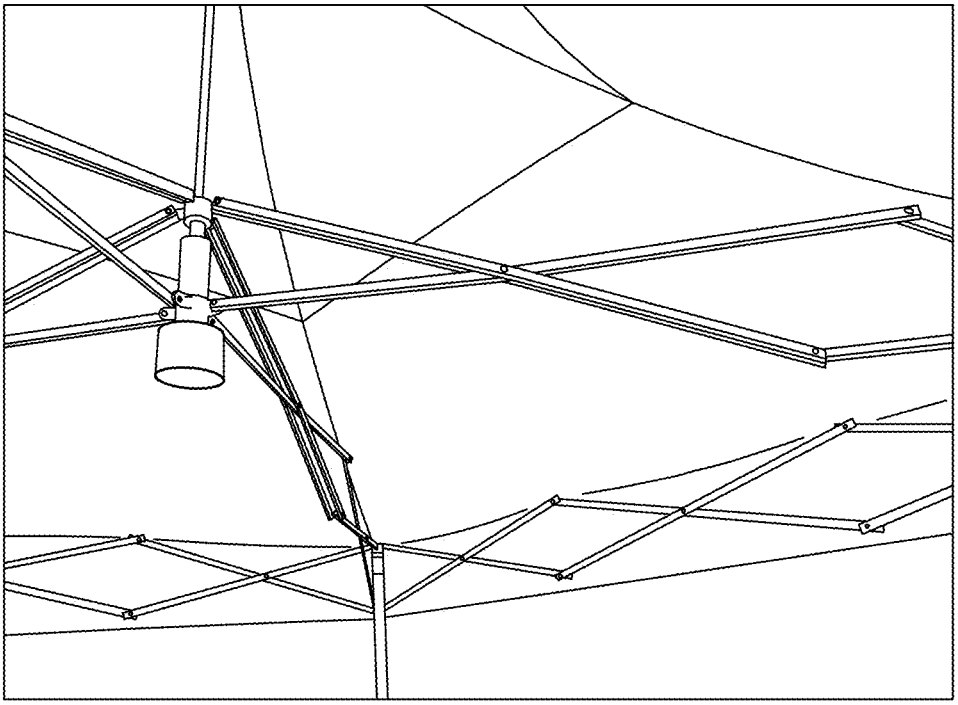
Figure 13:
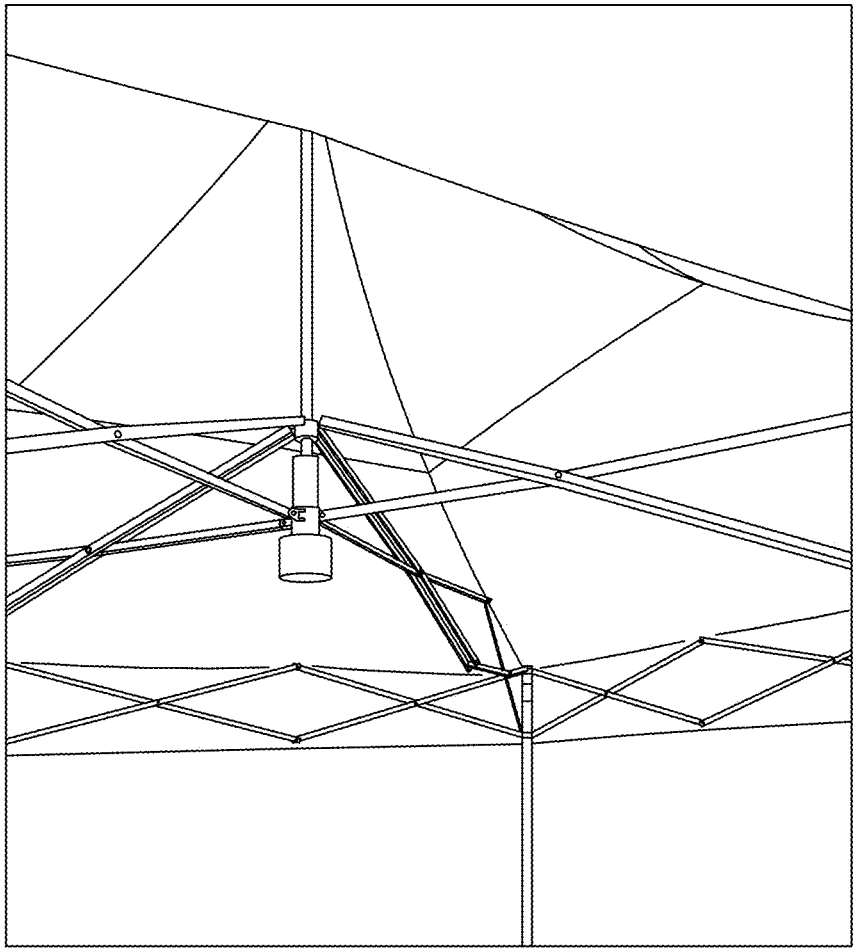

As illustrated in the embodiment of FIGS. 9-17, a compression spring CS may be provided coaxial to the lead screw LS at the lower end of the lead screw LS, above the drive motor DM. A washer WA is provided at the top end of the compression spring CS. As shown in the figures, as the lead screw LS rotates to drive the follower collar FC down towards the drive motorDM/fixed pivot joint FVJ (i.e., to extend the radial scissor frame members RSF), the follower collar FC will eventually press on the washer WA. Further rotation of the lead screw LS will cause the follower collar FC and the washer WA to press to compress the compression spring CS. FIG. 12 shows the fully compressed state of the compression spring CS when the radial scissor frame members RSF are in the fully extended state. The compression spring CS functions as a cushion to absorb any shock as the follower collar FC moves towards the drive motor.

The drive motor housing DH or the battery pack housing BH may be provided with switches BS to activate/control the drive motor, and/or to provide indication of battery charge level, and appropriate indicator lights.

In one embodiment, the central drive mechanism D may further or in the alternate comprise a wireless receiver receiving a remote control signal, which may be one of Bluetooth, wife, infrared and radio frequency (RF), to operatively control the drive motor DM to actuate the radial scissor frame members RSF for extending/collapsing the folding frame assembly F. The receiver may be included in the housing DH for the motor drive DM, or as part of the removable power supply BP. A dedicated handheld remote-control device may be provided to generate the remote-control signal. Alternatively, an application module installed in an electronic device (e.g., a mobile phone) may be used to generate the remote-control signal.

In an alternate embodiment, the linear actuator LA is configured to be operated by a manual crank drive in addition as a backup or in the alternative of an electric motor drive. A manual crank handle can be used to operatively rotate the lead screw drive linear actuator.

The telescopic leg assembly LS may be extended/retracted manually using a locking means to keep the leg assembly in the extended state.

In another aspect of the present invention, to further facilitate expanding/collapsing the folding frame assembly F in a coordinated fashion in unison, each leg assembly L comprises an extendable/retractable structure to vary the length of the overall leg assembly L to raise/lower the height of the folding frame assembly F, and wherein the second end of each radial scissor frame assembly RSF is operatively coupled to a corresponding leg assembly L in a manner wherein as the central drive mechanism D operates to simultaneously extend/retract the plurality of radial scissor frame members RSF, the second end of each radial scissor frame member RSF is simultaneously operated to extend/retract a corresponding leg assembly L in unison. Each leg assembly L further comprises a telescopic structure varying the length of the overall leg assembly, comprising an elongated base section Lb telescopic with respect to an elongated support section Ls at the upper portion of the leg assembly L. Each leg assembly L further comprises a leg drive mechanism driving the base section Lb to telescopically extend/retract with respect to the support section Ls. The leg drive mechanism comprises one of a cable drive, a ball screw gear drive, a lead screw gear drive, a rack and pinion gear drive, etc., which may be driven by the central drive mechanism D or separately driven by one or more drive motors in coordination with the central drive mechanism D. For example, a separate small or micro motor may be provided at each leg assembly L, to drive a lead screw gear drive to extend the base section with respect to the support section Ls of the leg assembly L.

Figure 18:
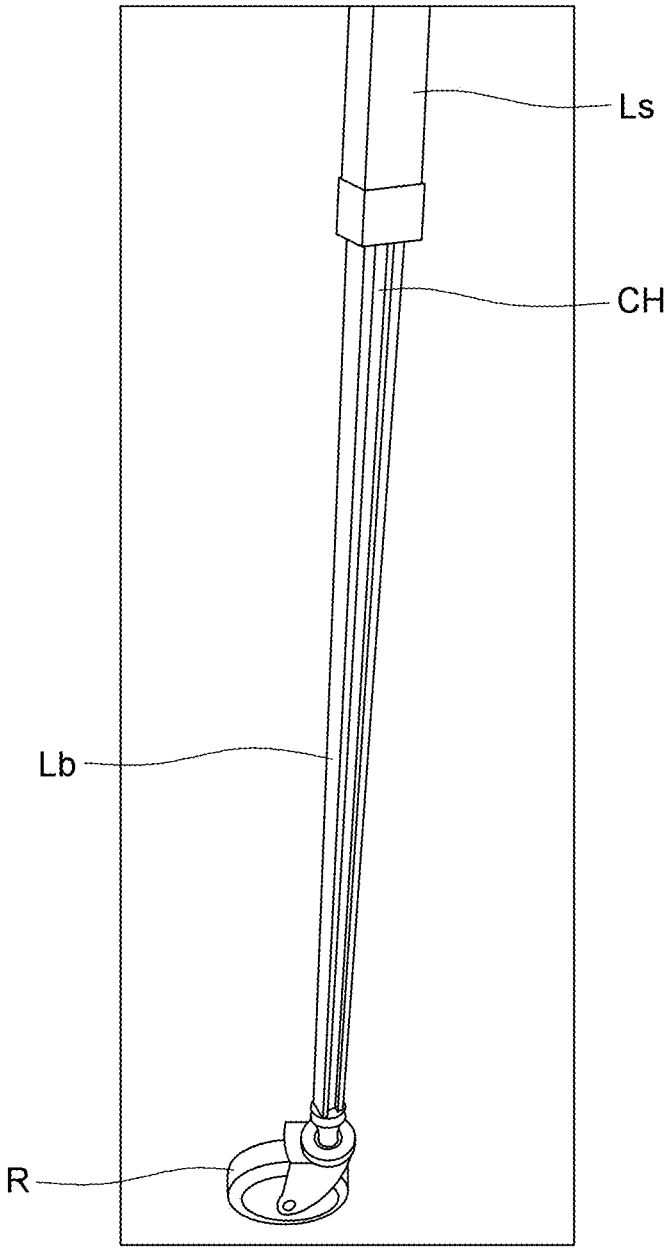
FIG. 18 depicts a telescopic leg of the folding frame assembly, in accordance with one embodiment of the present invention.

FIG. 18 depicts a telescopic leg of the folding frame assembly F, in accordance with one embodiment of the present invention. In the illustrated embodiment, the base section Lb of the leg assembly Ls is telescopically received in the support section Ls of the leg assembly L, and the leg drive mechanism comprises a cable drive. FIGA. 19A and 19B are schematic sectional views depicting the cable configuration for extending/retracting the telescopic leg to raise/lower the canopy frame, in accordance with one embodiment of the present invention.

The cable drive includes a cable CL having a fixed length with a first end and a second end connected to a top end of the base section, wherein the slidable pivot joint is coupled to a point along the length of the cable, wherein the length of the cable is looped from the top end of the base section through an aperture at an upper portion of the support section to extend outside the support section to the slidable pivot joint, and further from the slidable pivot joint to extend outside the support section through an aperture at a lower portion of the support section to extend inside the channel in the base section to the top end of the base section. The cable comprises a first cable section CS1 having a first end E1CS1 corresponding to the first end E1 of the cable connected to the top end Et of the base section Lb and a second end E2CS1 secured/anchored to the slidable pivot joint SPJ, and a second cable section CS2 having a first end E1CS2 secured/anchored to the slidable pivot joint SPJ and a second end E2CS2 corresponding to the second end E2 of the cable CL connected to the top end Et of the base section Lb. The first and second cable sections CS1, CS2 may be sections of a complete cable without a break, but fixedly connected to the slidable pivot joint SPJ, or may be separate sections separately connected to the slidable pivot joint SPJ. Pulleys PU may be provided to facilitate cable routing and movements.

Figure 19A:
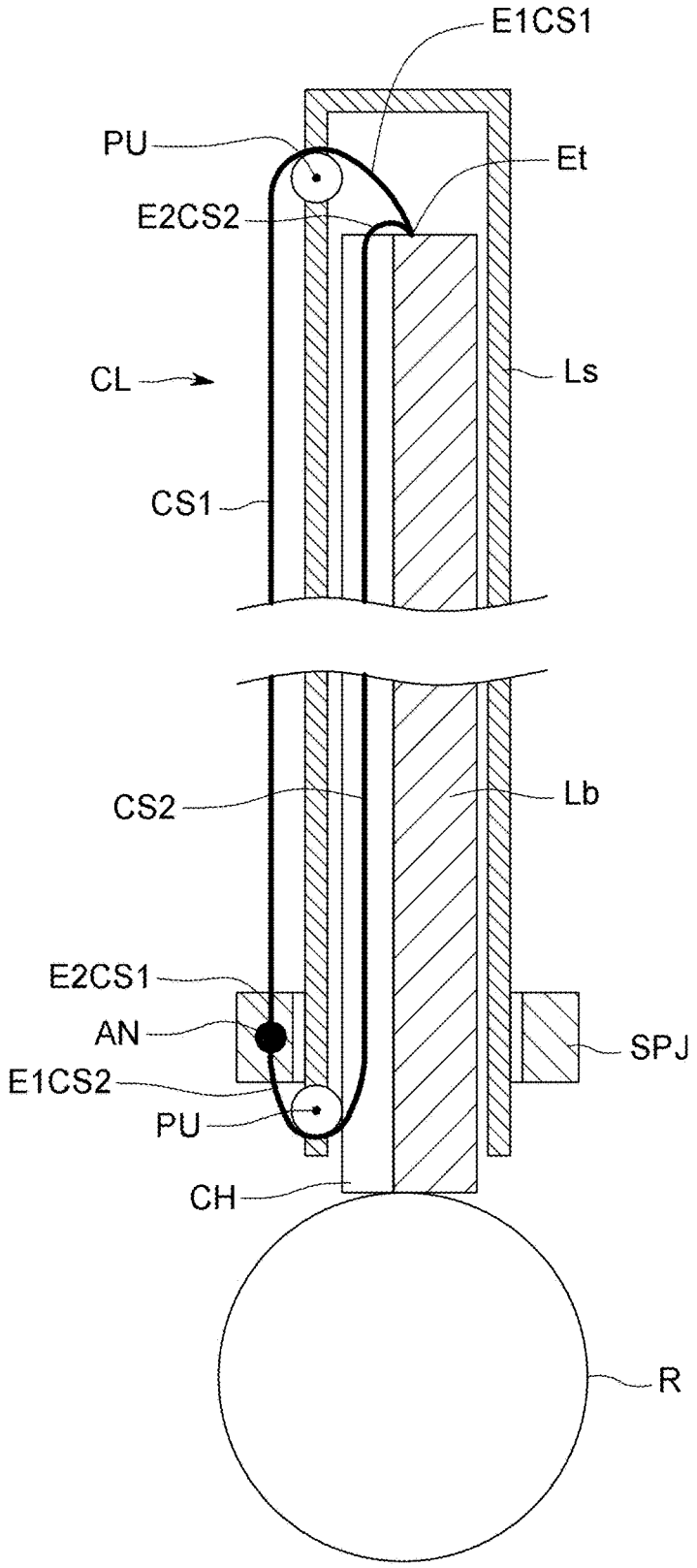
FIGS. 19A and 19B are schematic sectional views depicting the cable configurations for extending/retracting the telescopic leg assembly to raise/lower the canopy frame, in accordance with one embodiment of the present invention.

FIG. 19A depicts the base section Lb fully retracted into the support section Ls, with the canopy C in the collapsed configuration. As the folding frame assembly F collapses with the radial scissor frame member RSF (and the perimeter scissor frame member PSF in one embodiment) under actuation of the central drive mechanism D, the slidable pivot joint SPJ slides towards the bottom end of the support section of the telescopic leg assembly L, as described above. The slidable pivot joint SPJ therefore pulls the first cable section CS1 to a point that its first end E1CS1 (i.e., also the first end E1 of the overall cable CL) is near the top of the support section Ls, thereby retracting the base section Lb into the support section Ls. The second cable section CS2 extends along the channel CH in the base section Lb between the slidable pivot joint SPJ and the top end Et of the base section Lb. Therefore, the folding frame assembly F can be fully collapsed with the retraction of the various components of the folding frame assembly F including the leg assemblies L in synchronization in a coordinated fashion in unison, as depicted in the sequence from FIG. 1 to FIG. 8.

Figure 19B:
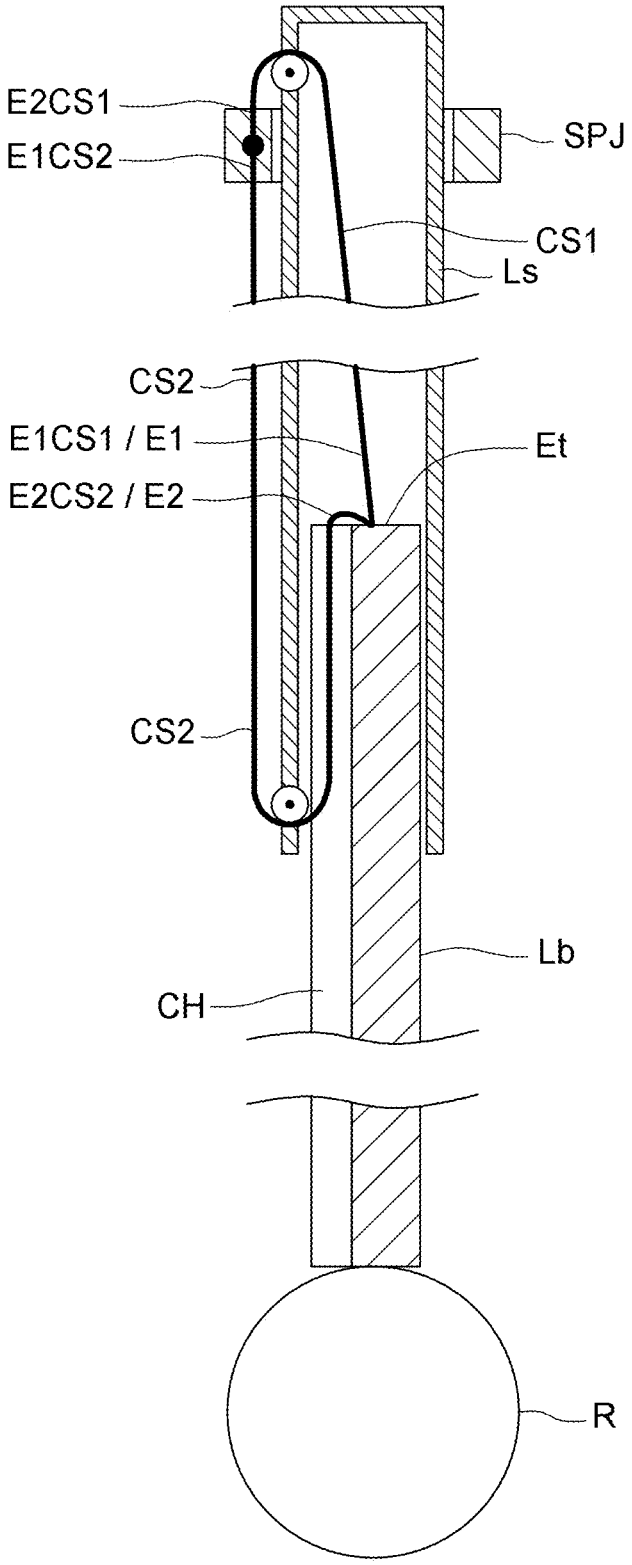

FIG. 19B depicts the base section Lb fully extended out of the support section Ls. As the folding frame assembly F expands with the radial scissor frame members RSF (and the perimeter scissor frame members PSF in one embodiment) under actuation of the central drive mechanism D, the slidable pivot joint SPJ slides towards the top end of the support section Ls of the telescopic leg assembly L, as described above. The slidable pivot joint SPJ thereby pulls the second cable section CS2 to a point that its second end E2CS2 (i.e., also the second end E2 of the overall cable CL) is near the bottom of the support section Ls, thereby extending the base section Lb out of the support section Ls. Therefore, the foldable frame assembly F can be fully raised with expansion of the various components of the folding frame assembly F including the leg assemblies L in synchronization in a coordinated fashion in unison, as depicted in the sequence from FIG. 8 to FIG. 1.

The radial scissor frame members RSF, the perimeter scissor frame members PSF, the leg assemblies L and other structural members/sections of the folding frame assembly F may be made of metal (e.g., steel, iron, aluminum, etc.), hard plastics, polymer or composite materials, etc., or combination of such materials. The canopy C may be made of a flexible material, such as canvas, plastic, fabric (woven or non-woven), bamboo weaved material, etc., or a combination of such materials. The canopy material may be porous, or non-porous.

As can be appreciated from the above detailed description and the drawings, the inventive collapsible shelter S includes a folding frame assembly F that can be actuated automatically by a central drive mechanism D to expand/collapse in a coordinated fashion in unison, with no or minimum user involvement or intervention beyond a user controlling the drive motor DM using control switches, a remote controller, or an app installed in an electronic device. Unlike the prior art collapsible shelters, the inventive collapsible shelter S does not require two persons to operate to expand and/or collapse the folding frame assembly. The inventive collapsible shelter S can be setup/erected with the components of the folding frame assembly F moving in unison in a coordinated fashion. The collapsible shelter S in its collapsed configuration is compact given its less complex folding frame assembly F, as compared to the prior art collapsible shelters.

While the present invention has been described above in connection with the illustrated embodiments, the scope of patent invention covers all possible present and future variations and improvements that is apparent from the disclosure above. While the invention has been particularly shown and described with reference to the preferred embodiments, it will be understood by those skilled in the art that various changes in form and detail may be made without departing from the spirit, scope, and teaching of the invention. Accordingly, the disclosed invention is to be considered merely as illustrative and limited in scope only as specified in the appended claims.

The invention claimed is:

1. A collapsible shelter, comprising:

a folding frame assembly having a perimeter with at least three corners, comprising:

a plurality of leg assemblies, each disposed at one of the at least three corners;

a central drive mechanism, disposed at a center of the perimeter; and a framework of a plurality of actuation members operatively coupled to the central drive mechanism and to the leg assemblies, wherein the actuation members are structured and configured to move the leg assemblies towards and away from the central drive mechanism; and a canopy supported on the folding frame assembly, wherein the central drive mechanism is configured to operate to simultaneously actuate the plurality of actuation members to move the leg assemblies in synchronization, thereby to expand and collapse the folding frame assembly in unison, wherein the actuation members are each a pivoted actuation mechanism operatively coupled to the central drive mechanism and to a corresponding leg assembly of the plurality of leg assemblies, wherein the pivoted actuation mechanism comprises pivotally coupled members that can pivot to vary the overall length of the pivoted actuation mechanism to extend/retract to move the corresponding leg assembly away/towards the central drive mechanism, wherein each pivotally coupled member is in the form of a radial scissor frame member comprising a linearly extendible/retractable scissor frame member defined by linked, pivoted members in a criss-cross 'X' pattern, wherein the radial scissor frame member has a first end pivotally coupled to the central drive mechanism and a second end pivotally connected to a corresponding coupling location in the perimeter, wherein the central drive mechanism is configured to operate the pivotally coupled members to simultaneously extend and retract the plurality of radial scissor frame members with the leg assembles in synchronization, thereby to expand and collapse the folding frame assembly in unison, wherein the second end of each radial scissor frame assembly is operatively coupled to a corresponding leg assembly in a manner wherein as the central drive mechanism operates to simultaneously extend/retract the plurality of radial scissor frame members, the second end of each radial scissor frame member is simultaneously operated to extend/retract a corresponding leg assembly in synchronization with the expand/collapse of the folding frame assembly in unison, wherein each leg assembly comprises an extendable and retractable structure to vary the length of the overall leg assembly to raise and lower the height of the folding frame assembly in synchronization with the actuation members, wherein each leg assembly comprises a telescopic structure varying the length of the overall leg assembly, comprising an elongated base section telescopic with respect to a support section at an upper portion of the leg assembly, wherein each leg assembly further comprises a leg drive mechanism driving the base section to telescopically extend/retract with respect to the support section, and wherein the base section is telescopically received in the support section, wherein the leg drive mechanism comprises a cable drive comprising a cable having a fixed length and having a first end and a second end connected to a top end of the base section, wherein a slidable pivot joint is slidably attached to the support portion at the upper portion of each leg assembly and the slidable pivot joint is coupled to a point along the length of the cable, wherein the length of the cable is looped from the top end of the base section through an aperture at an upper portion of the support section to the slidable pivot joint, and further from the slidable pivot joint through an aperture at a lower portion of the support section to the top end of the base section.

2. The collapsible shelter as in claim 1, wherein each radial scissor frame member is pivotally coupled to the upper portion of a corresponding leg assembly at the perimeter, and wherein simultaneous extension/retraction of the radial scissor frame members operates to simultaneously move the leg assemblies radially outwardly/inwardly relative to the central drive mechanism in synchronization, thereby to expand and collapse the folding frame assembly in unison.

3. The collapsible shelter as in claim 2, wherein the second end of each redial scissor frame member comprises a first pivot end portion pivotally connected to a fixed pivot joint fixedly attached to the support portion at the upper portion of each leg assembly, and a second pivot end portion pivotally connected to the slidable pivot joint that is slidably attached to the support portion at the upper portion of each leg assembly, wherein as the radial scissor frame extends, the slidable pivot joint slides along the support portion towards the fixed pivot joint, and as the radial scissor frame retracts, the slidable pivot joint slides along the support portion away from the fixed pivot joint.

4. The collapsible shelter as in claim 3, wherein the folding frame assembly further comprising a plurality of perimeter scissor frame members each comprising a linearly extendible/retractable scissor frame member defined by linked, pivoted members in a criss-cross 'X' pattern, wherein the perimeter scissor frame member extends across and has two ends pivotally connected to two adjacent leg assemblies, wherein simultaneous extension/retraction of the radial scissor frame members operate to also simultaneously extend/retract the perimeter scissor frame members in synchronization, thereby to expand/collapse the folding frame assembly in unison.

5. The collapsible shelter as in claim 4, wherein each end of each perimeter scissor frame member comprises a first pivot end portion pivotally connected to the fixed pivot joint fixedly attached to the support portion at the upper portion of each leg assembly, and a second pivot end portion pivotally connected to the slidable pivot joint that is slidably attached to the support portion at the upper portion of each leg assembly, wherein as the perimeter scissor frame member extends, the slidable pivot joint slides along the support portion towards the fixed pivot joint, and as the perimeter scissor frame member retracts, the slidable pivot joint slides along the support portion away from the fixed pivot joint.

6. The collapsible shelter as in claim 1, wherein the folding frame assembly further comprising a plurality of perimeter scissor frame members each comprising a linearly extendible/retractable scissor frame member defined by linked, pivoted members in a criss-cross 'X' pattern, wherein the perimeter scissor frame member extends across and has two ends pivotally connected to two adjacent leg assemblies, wherein simultaneous extension/retraction of the radial scissor frame members operate to also simultaneously extend/retract the perimeter scissor frame members in synchronization, thereby to expand/collapse the folding frame assembly in unison, and wherein the second end of each radial scissor frame member is coupled indirectly to the leg assemblies by the plurality of perimeter scissor frame members.

7. The collapsible shelter as in claim 6, wherein the second end of each radial scissor frame member is pivotally connected to a mid-section of a corresponding perimeter scissor frame member, wherein simultaneous extension/retraction of the radial scissor frame members operates to simultaneously extend/retract the perimeter scissor frame members to move the leg assemblies radially outwardly/inwardly relative to the central drive mechanism in synchronization, thereby to expand/collapse the folding frame assembly unison.

8. The collapsible shelter as in claim 1, wherein the leg assemblies each comprises a wheel at a lower end to facilitate rolling the leg assembly on a surface when the leg assembly moves outwardly/inwardly relative to the central drive mechanism.

9. The collapsible shelter as in claim 1, wherein the central drive mechanism comprises a linear actuator operatively coupled to the first end of each radial scissor frame member to extend/retract the radial scissor frame member.

10. The collapsible shelter as in claim 9, wherein the linear actuator is one of an electric actuator, a hydraulic actuator, a pneumatic actuator, a mechanical actuator, an electro-mechanical actuator.

11. The collapsible shelter as in claim 9, wherein the linear actuator comprises one of a ball screw gear, a lead screw gear, a rack and pinion gear, and a cable pulley drive, wherein the central drive mechanism further comprises an electric drive motor operatively coupled to the linear actuator.

12. The collapsible shelter as in claim 11, wherein the central drive mechanism further comprises a wireless receiving mechanism receiving a remote control signal via at least one of Bluetooth, wifi, infrared and radio frequency (RF), to operatively control the drive motor to operate the radial scissor frame members.

13. The collapsible shelter as in claim 12, further comprising a remote control device generating the remote control signal, or an application module installed in an electronic device generating the remote control signal.

14. The collapsible shelter as in claim 11, wherein the linear actuator is configured to be operated by a manual crank drive in addition or as a backup in the event the electric drive motor fails to operate.

15. The collapsible shelter as in claim 1, wherein the central drive mechanism comprises a removable rechargeable power supply.

16. The collapsible shelter as in claim 15, further comprising an external power port for receiving power from an external power supply as a backup to the rechargeable power supply, wherein the power port may be provided on the rechargeable power supply.

17. A collapsible shelter, comprising:

a folding frame assembly having a perimeter with at least three corners, comprising:

a plurality of leg assemblies, each disposed at one of the at least three corners;

a central drive mechanism, disposed at a center of the perimeter; and a framework of a plurality of actuation members operatively coupled to the central drive mechanism and to the leg assemblies, wherein the actuation members are structured and configured to move the leg assemblies towards and away from the central drive mechanism; and a canopy supported on the folding frame assembly, wherein the central drive mechanism is configured to operate to simultaneously actuate the plurality of actuation members to move the leg assemblies in synchronization, thereby to expand and collapse the folding frame assembly in unison, and wherein each leg assembly comprises an extendable and retractable structure to vary the length of the overall leg assembly to raise and lower the height of the folding frame assembly in synchronization with the actuation members, wherein each leg assembly comprises a telescopic structure varying the length of the overall leg assembly, comprising an elongated base section telescopic with respect to a support section at an upper portion of the leg assembly, wherein each leg assembly further comprises a leg drive mechanism driving the base section to telescopically extend/retract with respect to the support section, wherein the base section is telescopically received in the support section, wherein the leg drive mechanism comprises a cable drive comprising a cable having a fixed length and having a first end and a second end connected to a top end of the base section, wherein a slidable pivot joint is slidably attached to the support portion at the upper portion of each leg assembly and the slidable pivot joint is coupled to a point along the length of the cable, wherein the length of the cable is looped from the top end of the base section through an aperture at an upper portion of the support section to the slidable pivot joint, and further from the slidable pivot joint through an aperture at a lower portion of the support section to the top end of the base section.

18. The collapsible shelter as in claim 17, wherein the cable comprises a first cable section having a first end corresponding to the first end of the cable connected to the top end of the base section and a second end connected to the slidable pivot joint, and a second cable section having a first end connected to the slidable pivot joint and a second end corresponding to the second end of the cable connected to the top end of the base section.

19. The collapsible shelter as in claim 18, wherein the folding frame assembly comprises a rectangular perimeter having four corners and four leg assemblies.

* * * * *